US006854132B1

(12) United States Patent
Polzin

(10) Patent No.: US 6,854,132 B1
(45) Date of Patent: Feb. 15, 2005

(54) NURSING GARMENT

(76) Inventor: Sarah Polzin, 1246 Hermes Ave., Encinitas, CA (US) 92024

( * ) Notice: Subject to any disclaimer, the term of this patent is extended or adjusted under 35 U.S.C. 154(b) by 0 days.

(21) Appl. No.: 10/635,028

(22) Filed: Aug. 6, 2003

(51) Int. Cl.[7] ..... A41D 1/20; A41C 3/04
(52) U.S. Cl. ..... 2/104; 450/36
(58) Field of Search ..... 2/69, 104–107, 2/113–115, 118–121, 67; 450/36, 31, 32

(56) References Cited

U.S. PATENT DOCUMENTS 1,254,043 A * 1/1918 James ..... 450/31
1,566,267 A * 12/1925 Mapearl ..... 450/31
1,664,214 A 3/1928 Hudson
2,510,012 A * 5/1950 Edelman ..... 450/52
2,703,885 A * 3/1955 Davis ..... 450/3
3,449,763 A 6/1969 Grate
3,611,439 A 10/1971 Meyers
3,771,172 A * 11/1973 Barg ..... 2/67
4,144,593 A 3/1979 Timmons
4,208,743 A 6/1980 Whitcraft
4,280,228 A 7/1981 Sulzmann
4,372,320 A * 2/1983 Silber ..... 450/31
4,378,805 A * 4/1983 Reichert et al. ..... 450/26
4,440,174 A * 4/1984 Cordova ..... 450/31
4,528,699 A 7/1985 Hughes
4,590,945 A * 5/1986 Fiel ..... 450/31
4,601,068 A * 7/1986 Frechette ..... 2/104
4,648,404 A 3/1987 Clark
4,797,954 A * 1/1989 Williams et al. ..... 2/106
4,798,557 A * 1/1989 Scott ..... 450/31
4,911,677 A * 3/1990 White ..... 450/36
5,033,986 A * 7/1991 Feigenbaum et al. ..... 450/30
5,045,018 A 9/1991 Costanzo
5,182,813 A 2/1993 Booze
5,461,725 A 10/1995 Witczak
5,611,086 A 3/1997 Eggen
5,697,830 A * 12/1997 White ..... 450/36
5,946,726 A * 9/1999 Green ..... 2/109
6,032,288 A * 3/2000 Simone ..... 2/69
6,059,633 A * 5/2000 Currier ..... 450/31
6,068,538 A * 5/2000 Alleyne ..... 450/58
6,162,111 A 12/2000 Heroff
6,178,784 B1 1/2001 Marley, Jr.
6,282,719 B1 9/2001 Vera et al.
6,443,805 B1 9/2002 Kirkwood
6,530,820 B1 * 3/2003 Katze et al. ..... 450/7
6,550,067 B2 4/2003 Force
6,645,041 B2 * 11/2003 Sørensen ..... 450/36

* cited by examiner

*Primary Examiner*—John J. Calvert
*Assistant Examiner*—Alissa L. Hoey
(74) *Attorney, Agent, or Firm*—Richard C. Litman

(57) ABSTRACT

The nursing garment of the present invention includes an outer garment and an inner garment. The outer garment can be any suitable garment which has a tubular body for covering the upper body region. The inner garment is disposed within the tubular body of the outer garment and attached to the outer garment. The inner garment can be any camisole-type garment which includes two chest panels that overlap with one another in criss-cross fashion. The chest panels receive and support the wearer's breasts. A nursing mother may raise the outer garment over her chest and pull either chest panel below her breast to make her breast accessible to her baby.

14 Claims, 7 Drawing Sheets

NURSING GARMENT

BACKGROUND OF THE INVENTION

1. Field of the Invention

The present invention relates generally to garments, and particularly, to a fashionable nursing garment which permits a mother to nurse her child discreetly.

2. Description of the Related Art

In the past, nursing garments have failed to sufficiently conceal a woman's breasts or lower torso while she is nursing, or have included too many obvious functional features which detract from the appearance of the garment and make it obvious that the woman is wearing a nursing garment. Additionally, nursing garments have generally been limited to only a few particular styles.

One such style is the slit-type garment. Slits require either cumbersome adjustment of clothing and do not sufficiently cover the wearer's breasts while nursing. Also, a slit does not lend itself to any type of form-fitting design as it must be incorporated into an A-line type loose garment.

Another example of nursing garment is the covering-element type of garment in which patches and flaps are used to cover the wearer's breasts. Patches and flaps, however, are also cumbersome and often require manipulation of connecting elements such as buttons, zippers, or hook and loop fasteners for exposure of the breasts, which takes time to do and can get complicated when the mother is trying to hold onto a hungry baby while undoing the fasteners. Due to their location, the buttons and zippers detract from the appearance of the garment. The flaps are often unsightly, giving the front of the garment a st range appearance, and readily reveal the garment's function, which may be embarrassing.

U.S. Pat. No. 5,045,018, issued Sep. 3, 1991 to Anna M. Costanzo, discloses a camisole embodying brassiere cups joined with a separate stretchable strip laterally placed at the base of brassiere cups and body of the camisole. The camisole combined with brassiere cups can be used to improve the appearance of the wearer and can be worn in place of a plurality of inner garments.

U.S. Pat. No. 5,461,725, issued Oct. 31, 1995 to P. A. Witczak, discloses a garment featuring stretchable, resilient straps and a bodice. The straps are sufficiently resilient and suitably stretchable so that when a women wearing the garment pulls down the bodice, she can expose a breast for nursing and when through, she can return the bodice to its original position covering the breast.

U.S. Pat. No. 6,550,067, issued Apr. 22, 2003, to J. B. Force, discloses a brassiere garment for use in nursing. The brassiere portion of the garment is provided with cups which can be opened and closed without having to unfasten a brassiere garment from a wearer.

Other patents relating to nursing garments include U.S. Pat. No. 1,664,214, issued Mar. 27, 1928 to I. G. Hudson (inner garment with V-shaped sections detachably secured to the garment); U.S. Pat. No. 3,449,763, issued Jun. 17, 1969 to G. F. Grate (inner garment with self-contained means for exposing one or both breasts for nursing an infant); U.S. Pat. No. 3,611,439, issued Oct. 12, 1971 to P. L. Meyers (gown includes pair of breast-covering panels); U.S. Pat. No. 4,144,593, issued Mar. 20, 1979 to S. D. Timmons (garment with panel hinged at top to cover open breast area); U.S. Pat. No. 4,208,743, issued Jun. 24, 1980 to L. S. Whitcraft (gown with apertures proximate each arm); U.S. Pat. No. 4,280, 228, issued Jul. 28, 1981 to D. J. Sulzmann (nursing blouse with openings concealed by overlapping portions of the blouse); U.S. Pat. No. 4,528,699, issued Jul. 16, 1985 to S. D. Hughes (nursing blouse with separable sections to make breast accessible to baby); U.S. Pat. No. 4,648,404, issued Mar. 10, 1987 to S. A. Clark (coordinated slip and bra); U.S. Pat. No. 5,182,813, issued Feb. 2, 1993 to J. E. Booze (nursing garment with pleats); U.S. Pat. No. 5,611,086, issued Mar. 18, 1997 to K. R. Eggen (nursing garment including vest); U.S. Pat. No. 6,162,111, issued Dec. 19, 2000 to S. L. Heroff (women's clothing apparel including a built-in bra); U.S. Pat. No. 6,178,784 Bi, issued Jan. 30, 2001 to J. W. Marley Jr. (knit criss-cross brassiere); U.S. Pat. No. 6,282,719, issued Sep. 4, 2001 to C. A. Vera et al. (combination nightgown and bra); and U.S. Pat. No. 6,443, 805, issued Sep. 3, 2002 to K. Kirkwood (bra shelf and application thereof).

None of the above inventions and patents, taken either singly or in combination, is seen to describe the instant invention as claimed. Thus a nursing garment solving the aforementioned problems is desired.

SUMMARY OF THE INVENTION

The nursing garment of the present invention includes an outer garment and an inner garment. The outer garment can be any suitable garment which has a tubular body for covering the upper body region. The inner garment is disposed within the tubular body of the outer garment and attached to the outer garment. The inner garment can be any camisole-type garment which includes two chest panels that overlap with one another in criss-cross fashion. The chest panels receive and support the wearer's breasts. A nursing mother may raise the outer garment over her chest and pull either chest panel below the breast to make her breast accessible to her baby.

Accordingly, it is a principal object of the invention to provide a nursing garment that may take on any one of countless attractive styles and be embodied in any number of different types of wearing apparel without inhibiting the freedom of the woman to nurse as frequently as may be required.

It is another object of the invention to provide a nursing garment which allows the wearer to nurse a child without removing the garment.

It is a further object of the invention to provide a nursing garment which allows the wearer to nurse a child while keeping her breasts substantially covered.

Still another object of the invention is to provide a nursing garment which incorporates important functional features without detracting from styling or aesthetic considerations.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
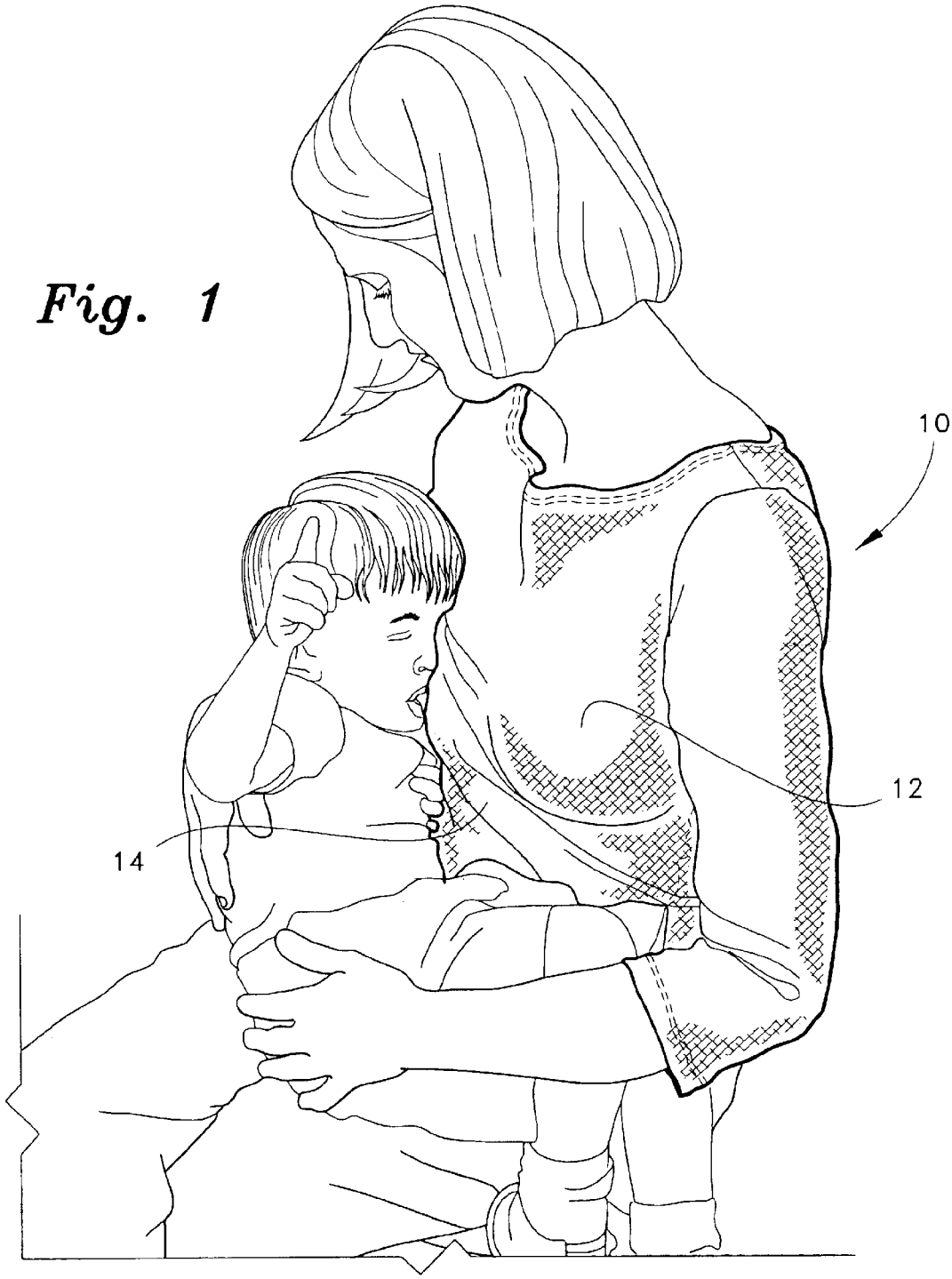
FIG. 1 is an environmental, perspective view of a nursing garment according to the present invention.

The present invention relates to a nursing garment, generally designated as 10 in the drawings. As shown in FIG. 1, the nursing garment 10 includes an outer garment 12 and an inner garment 14 which is attached to the outer garment. The nursing garment allows a nursing mother to breastfeed her child without undesired exposure of her body.

Figure 2:
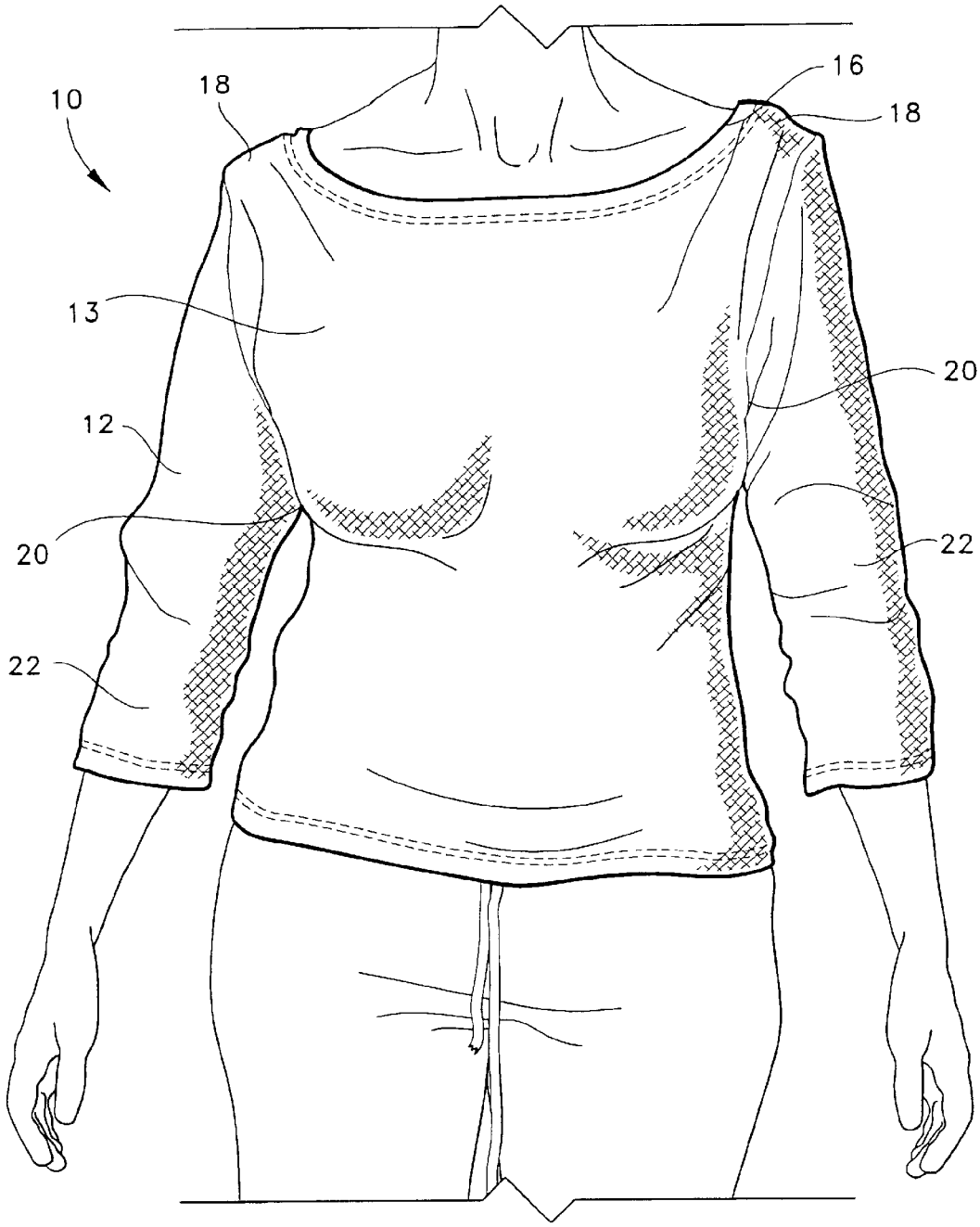
FIG. 2 is an environmental front view of the nursing garment according to the present invention, particularly showing the outer garment.

The outer garment 12 can be any suitable garment or women's clothing apparel that covers the upper body region, including the breasts, for example, dresses, blouses, t-shirts, tank tops, etc. Preferably, however, the outer garment 12 is a woman's shirt having a tubular body 13 with a neck 16, a shoulder portion 18 on either side of the neck 16, and a first underarm portion 20 below each shoulder portion 18, as shown in FIG. 2. The outer garment 12 may optionally include a pair of sleeves 22, disposed at opposite sides of the tubular body 13 being attached at the armhole opening defined by each shoulder portion 18 and underarm portion 20.

The outer garment 12 is completely smooth with no obvious openings to the breasts. An outer garment which opens down the front and is buttoned, zipped, or otherwise fastened is not preferred, because (1) it takes time to unfasten and may be difficult to manipulate while trying to hold a hungry baby; and (2) a garment which opens down the front renders it difficult to cover the exposed portion of the breast for modesty while nursing the infant. For this reason, the outer garment 12 is preferably a pullover type of shirt or blouse, which may be lifted to expose the breast and then lowered to discreetly cover the upper portion of the breast after the infant has attached himself or herself to the nipple.

Figure 3:
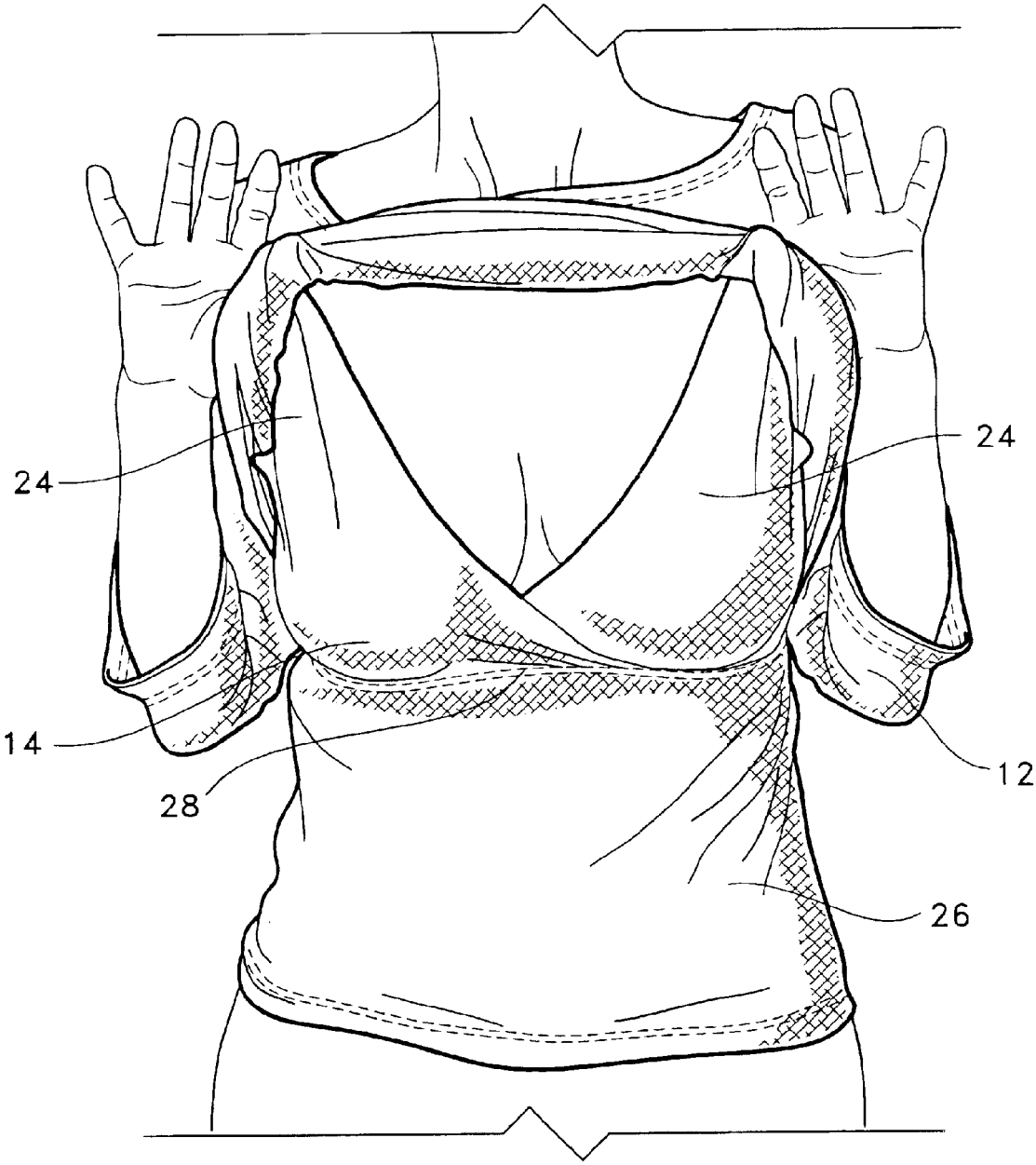
FIG. 3 is an environmental front view of the nursing garment according to the present invention, the outer garment being raised to show the inner garment.

FIG. 3 depicts a front view of the nursing garment 10 with the outer garment 12 raised to reveal the inner garment 14. As is shown, the inner garment 14 is disposed within the tubular body 13 of the outer garment 12. The inner garment is configured as a camisole or other similar garment. In this view, two chest panels 24, also referred to as breast panels, and a front torso panel 26 of the inner garment 14 can be seen. Preferably, a horizontal seam 28 is sewn to attach a bottom edge of the two chest panels 24 to a top edge of the front torso panel 26. As can be seen, the chest panels 24 partially overlap with one another, in criss-cross fashion.

Figure 4:
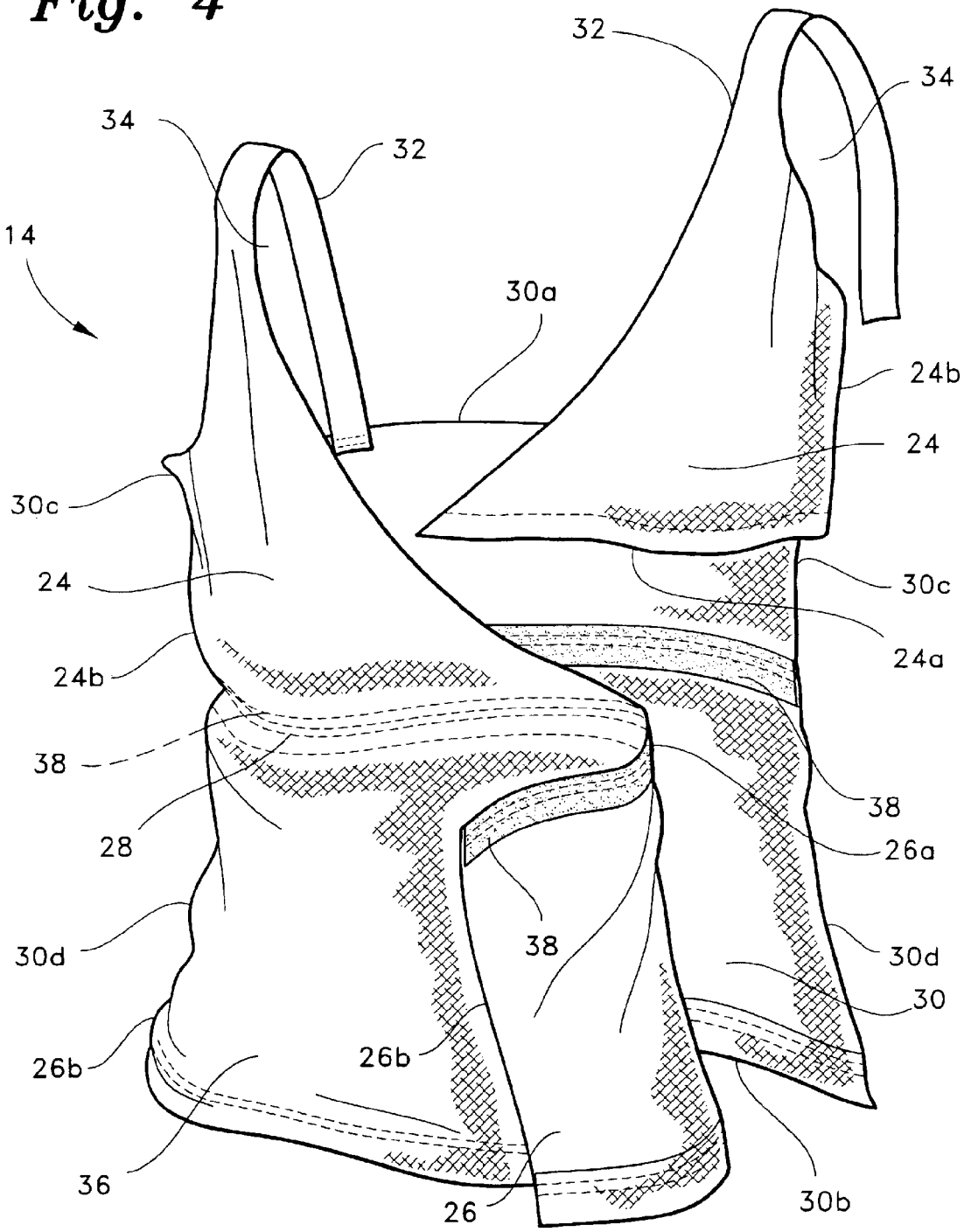
FIG. 4 is a perspective, partly exploded view of the inner garment, the left chest panel being detached and the front of the torso being folded back to show details of the interior of the inner garment.

As is depicted in FIG. 4, the nursing garment 10 further includes a back panel 30 having a top edge 30*a*, a bottom edge 30*b*, and opposing upper and lower side edges, 30*c* and 30*d*. A side edge 24*b* of each chest panel 24 is attached to one of the upper side edges 30*c* of the back panel 30. A shoulder strap 32 extends from an upper portion of each chest panel and is attached to the top edge 30*a* of the back panel 30, to define armholes 34. The shoulder straps 32 and the chest panels 24 may be integrally connected together, as is shown, or made from separate pieces. Constructing the chest panel 24 and shoulder strap from a single, continuous piece of fabric does have the advantage of eliminating shear stress at the junction of the breast panel 24 and strap 32 from repeated lowering of the breast panel 24, as well as preventing unsightly bulges from seams or tenderness from rubbing a metal ring or other link against the breast. It simply becomes easier and more comfortable to manipulate the chest panel 24 and shoulder strap 32 when they are made as a continuous unit.

Opposing side edges 26*b* of the front torso panel 26 are attached to the lower side edges 30*d* of the back panel 30, forming a torso tube 36. The torso tube 36 is configured to completely surround and cover the lower torso of the wearer.

Figure 5:
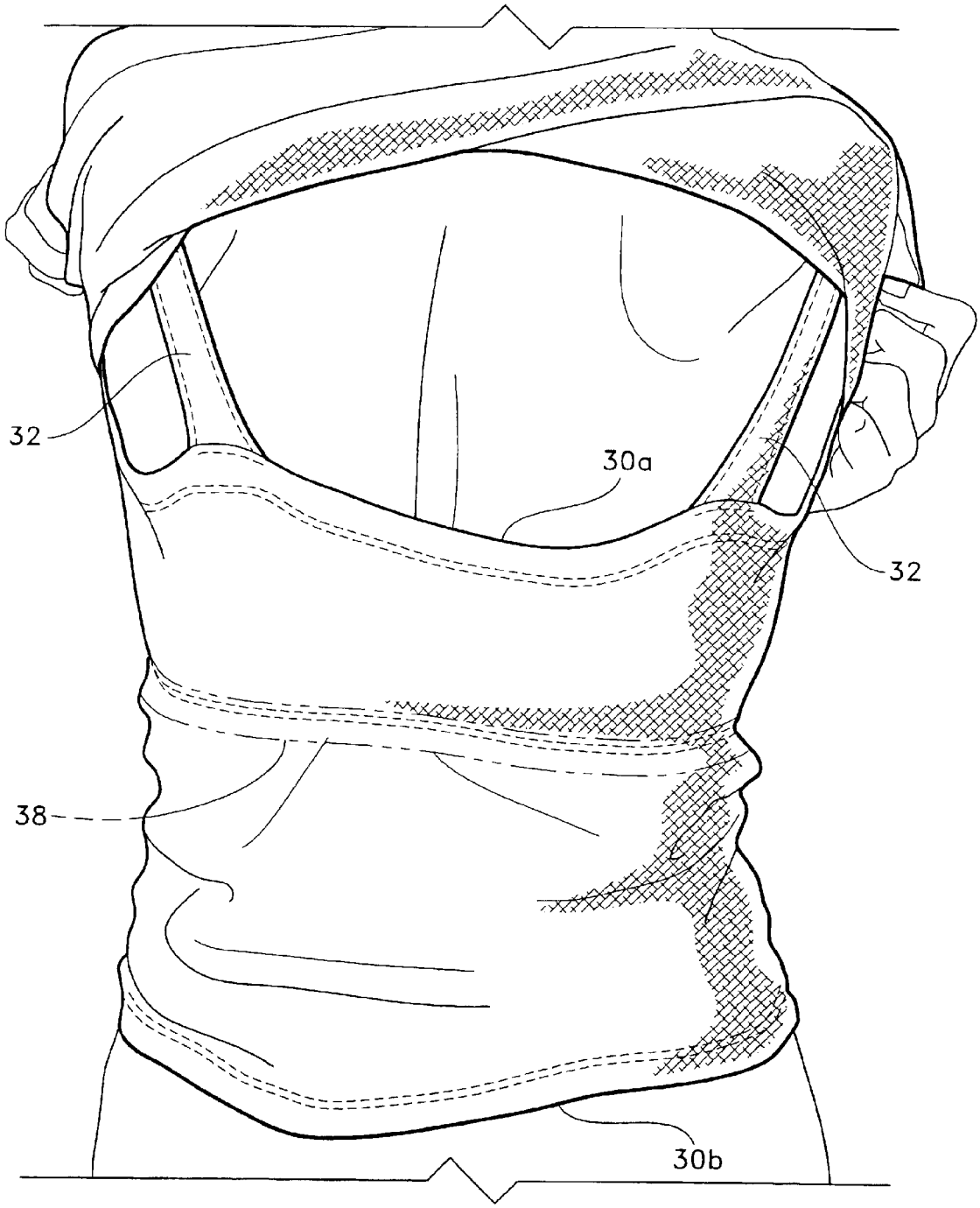
FIG. 5 is an environmental rear view of the nursing garment according to the present invention, the outer garment being raised to show the inner garment.

An elastic band 38 is disposed circumferentially along an inner surface of the inner garment 14 at a level just below the chest panels 24 or bustline of the inner garment 14. Attachment of the elastic band across the back panel 30 generally defines the upper side edge 30*c* and lower side edge 30*d*. The elastic band 38 is attached to the horizontal seam 28 which joins the chest panels 24 and the front torso panel 26 and to a corresponding portion of the back panel 30. The elastic band 38 serves to gather the chest panels 24 around a wearer's breasts so that the chest panels 24 may better receive and support the wearer's breasts. The elastic band 38 forms a shelf bra effect, raising and extending the breasts forward to enhance the attractiveness of the nursing garment 10, and providing a degree of independence from the torso panel 26, so that the chest panels 24 are not lowered by movement of the torso panel 26. The positioning of the elastic band across the back panel can be seen more clearly in FIG. 5.

Figure 6:
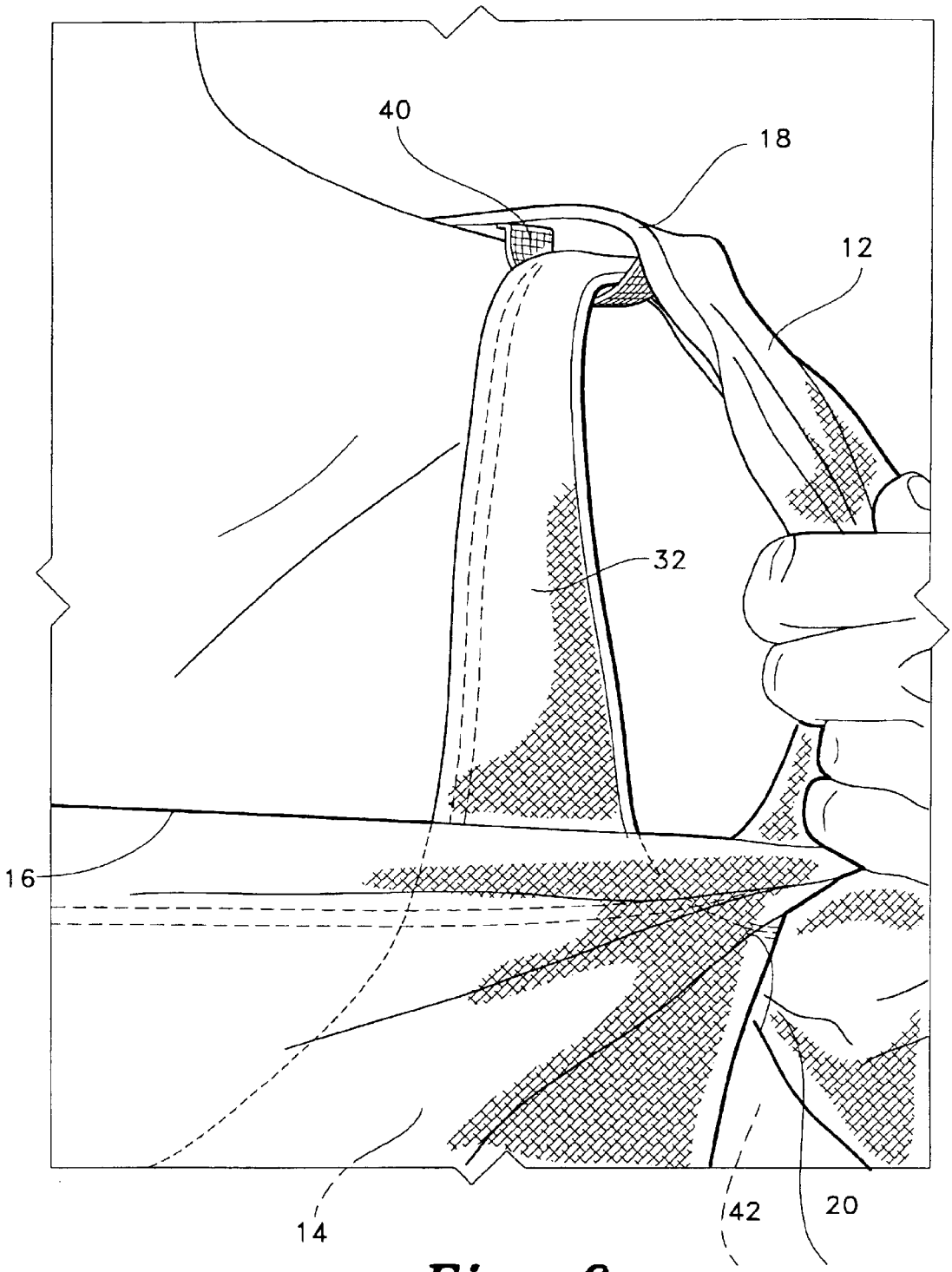
FIG. 6 is an environmental front view the nursing garment with the collar or neckline of the outer garment pulled back to show a shoulder strap and shoulder portion of the nursing garment according to the present invention.
Figure 7:
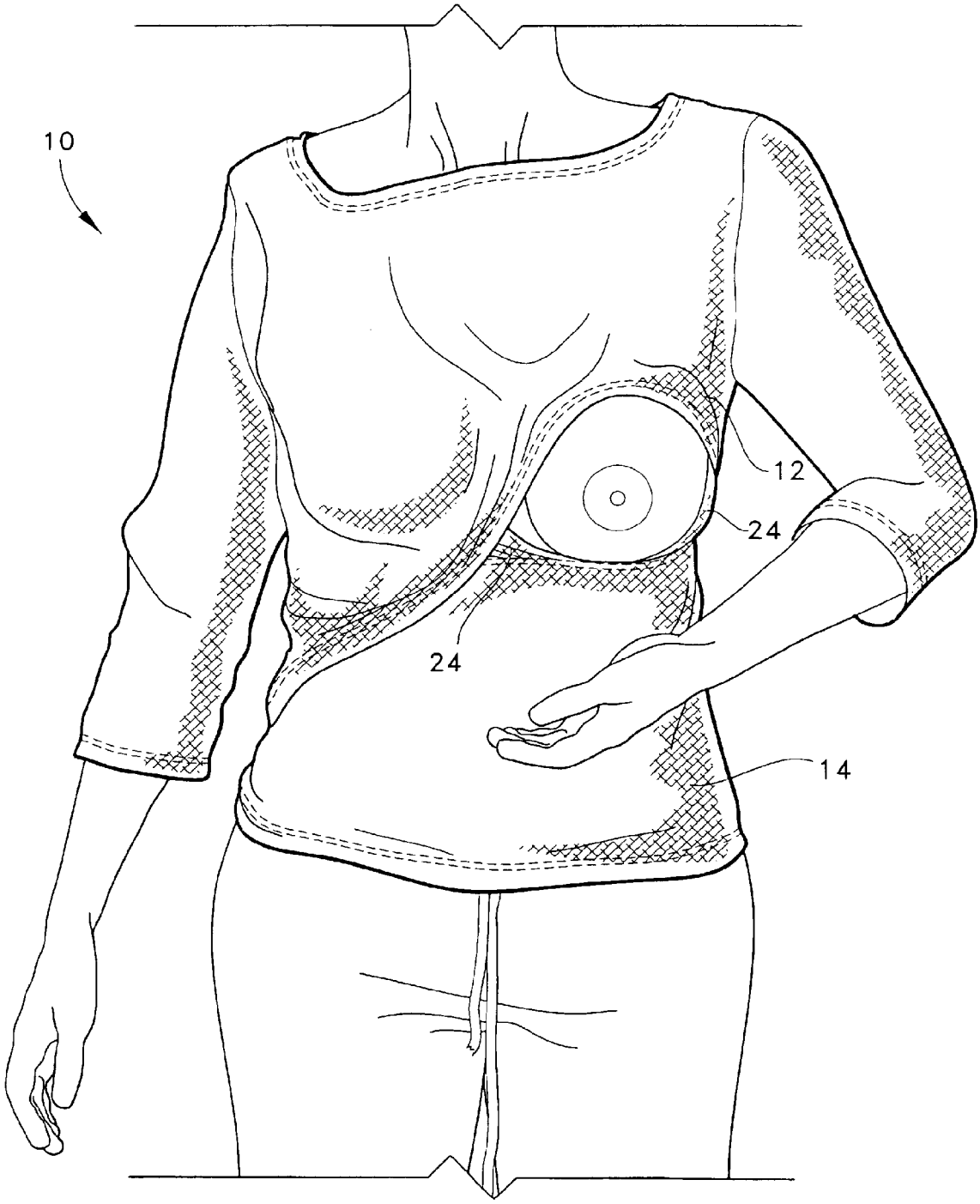
FIG. 7 is a front view of the nursing garment according to the present invention with the outer garment raised and the left chest panel lowered to expose a breast of the wearer.

The inner garment 14 and the outer garment 12 may be attached together by any suitable means at any suitable position. FIG. 6 depicts the outer garment 12 with the neck outstretched to reveal one shoulder strap 32 of the undergarment 14. As shown, it is preferable to join the shoulder straps 32 of the inner garment 14 to the shoulder portions 18 of the outer garment 13. Preferably, a strap 40 of suitable material is configured to loop around each shoulder strap 32 and attach to each shoulder portion 18. While any suitable material may be used, the strap 40 is preferably twill tape or ribbon. Additionally, the first underarm portions 20 of the outer garment 12 are attached to a second underarm portion 42 below each armhole 34 of the inner garment 14 by sewing.

The nursing garment 10 can be made from any suitable lightweight fabric that is also flexible and breathable. Preferably, both the outer garment 12 and the inner garment 14 are made from a blend of cotton and spandex material, such as Lycra™. A fabric containing 95% cotton and 5% Lycra™ is particularly suitable for achieving the desired degree of flexibility and breathability. The inner garment 14 and the outer garment 12 may also be of the same color, enhancing the attractiveness of the nursing garment 10.

By wearing the nursing garment 10 of the present invention, a nursing mother can easily nurse a child with minimal exposure of her body. After raising the outer garment 12 above her chest, a nursing mother may pull one of the chest panels 24 downwardly beneath her breast to make her breast accessible to the baby as can be seen in FIG.

7. The chest panels 24 lack any foam padding or stiffening material used to form bra cups, so that the chest panels are completely flexible, the spandex allowing the chest panels to be easily lowered to expose the breast without undoing any fasteners, while being sufficiently resilient to support the breasts, but not being tight enough to bind the breasts. The cotton material is soft for comfort, while being somewhat absorbent to wick up small amounts of moisture without staining the outer garment 12. While the wearer is breastfeeding, any part of the breast which is not concealed by the child's head may be covered by lowering the outer garment the outer garment 12. The wearer's stomach and back also remain hidden from public view since the torso tube 36 of the inner garment 14 remains in place.

Consequently, the nursing garment 10 of the present invention provides a comfortable, attractive, functional garment for nursing mothers.

It is to be understood that the present invention is not limited to the embodiments described above, but encompasses any and all embodiments within the scope of the following claims.

I claim:

1. A nursing garment to be worn by a woman for breastfeeding a baby, comprising:

an outer garment having a tubular body, the tubular body including a neck, a shoulder portion on either side of said neck, and a first under arm portion below each shoulder portion;

an inner garment secured within said tubular body of said outer garment, said inner garment including two chest panels and a front torso panel, a back panel, and a pair of shoulder straps, each said chest panel having a lower edge secured to a top edge of said front torso panel, said back panel having opposing side edges contiguous with a side edge of each said chest panel and side edges of said torso panel for encompassing the upper body of a wearer, said shoulder straps extending between and connecting a top edge of said back panel and an upper portion of said chest panels; and an elastic band disposed circumferentially along an inner surface of the inner garment along a bustline at a bottom edge of the chest panels, said elastic band encircling the inner garment;

whereby said tubular body of said outer garment may be raised and each said chest panel of said inner garment may be pulled downward under the woman's breast to make the breast accessible to a baby while nursing.

2. The nursing garment of claim 1, wherein at least a portion of said chest panels are disposed in overlapping position relative to one another.

3. The nursing garment of claim 1, wherein the shoulder straps and the chest panels are formed in one continuous piece.

4. The nursing garment of claim 1, wherein the outer garment comprises a woman's blouse.

5. The nursing garment of claim 1, wherein the outer garment comprises a woman's t-shirt.

6. The nursing garment of claim 1, wherein the outer garment is a woman's tank top.

7. The nursing garment of claim 1, wherein said first underarm portion of the outer garment is attached to a second underarm portion of the inner garment.

8. The nursing garment of claim 1, wherein said inner garment and said outer garment are made from a flexible, lightweight material.

9. The nursing garment of claim 1, wherein said inner garment and said outer garment are made from a blend of cotton and spandex material.

10. The nursing garment of claim 1, wherein said inner garment and said outer garment are made from a fabric containing 95% cotton and 5% spandex.

11. A nursing garment to be worn by a woman for breastfeeding a baby, comprising:

an outer garment having a tubular body, the tubular body including a neck, a shoulder portion on either side of said neck, and a first under arm portion below each shoulder portion;

an inner garment secured within said tubular body of said outer garment, said inner garment including two chest panels and a front torso panel, a back panel, and a pair of shoulder straps, each said chest panel having a lower edge secured to a top edge of said front torso panel, said back panel having opposing side edges contiguous with a side edge of each said chest panel and side edges of said torso panel for encompassing the upper body of a wearer, said shoulder straps extending between and connecting a top edge of said back panel and an upper portion of said chest panels; and a strap looped around each shoulder strap of the inner garment and affixed to the shoulder portion of the outer garment;

whereby said tubular body of said outer garment may be raised and each said chest panel of said inner garment may be pulled downward under the woman's breast to make the breast accessible to a baby while nursing.

12. The nursing garment of claim 11, wherein said strap is formed from twill tape.

13. The nursing garment of claim 11, wherein said strap comprises a ribbon.

14. A nursing garment for a woman nursing an infant, comprising:

a pullover blouse made from a soft, stretchable fabric and having a tubular body including a pair of shoulders defining armholes and a torso portion;

an undergarment made from a soft, stretchable fabric having:

a back panel having opposing side edges, a top edge and a bottom edge;

a left breast panel and a right breast panel, each breast panel having a bottom edge, a side edge attached to the corresponding side edges of the back panel, and a shoulder strap attached to the top edge of the back panel;

a front torso panel having a top edge, a bottom edge, and opposing side edges attached to the side edges of the back panel; and an elastic band, the elastic band being sewn across the back panel and along a seam joining the bottom edge of the breast panels and the top edge of the front torso tube, the elastic band forming a gather beneath a bustline of the undergarment and encircling the undergarment, whereby the undergarment forms a camisole with built-in nursing bra;

a left strap and a right strap, the straps being attached to the shoulders of the blouse and defining a loop, the shoulder strap of the left and right breast panels passing through the loops formed by the left and right straps, respectively, the undergarment further being attached to the blouse beneath the armholes;

whereby the woman may raise the blouse, lower one of the breast panels to nurse the infant, and lower the blouse to cover any exposed portion of her breast for modesty, the front torso panel of the undergarment covering the woman's torso.

* * * * *